US005512030A

United States Patent [19]

Barkus

[11] Patent Number: 5,512,030

[45] Date of Patent: Apr. 30, 1996

[54] CENTRIFUGE ROTOR

[75] Inventor: David A. Barkus, Oakville, Conn.

[73] Assignee: E. I. Du Pont de Nemours and Company, Wilmington, Del.

[21] Appl. No.: 352,695

[22] Filed: Dec. 1, 1994

[51] Int. Cl.[6] ..... B04B 5/02

[52] U.S. Cl. ..... 494/16

[58] Field of Search ..... 494/12, 16, 39, 494/43, 60, 64, 85; 220/212.5, 307, 308; 215/355, 228

[56] References Cited

U.S. PATENT DOCUMENTS

| | | | |
|---|---|---|---|
| 1,867,677 | 7/1932 | Nielsen | 220/212.5 |
| 2,034,007 | 3/1936 | Smith | 220/270 |
| 2,699,289 | 1/1955 | Allen et al. | 494/16 |
| 3,056,361 | 10/1962 | Law | 220/307 |
| 3,268,106 | 8/1966 | Satz | 220/308 |
| 3,708,111 | 1/1973 | Sheeler et al. . | |
| 3,819,111 | 6/1974 | Romanauskas et al. | 494/16 |
| 3,843,045 | 10/1974 | Schmidt et al. . | |
| 3,901,434 | 8/1975 | Wright . | |
| 3,970,245 | 7/1976 | Aeschlimann | 494/16 |
| 3,998,383 | 12/1976 | Romanauskas et al. | 494/16 |
| 4,010,890 | 3/1977 | Wright . | |
| 4,221,325 | 9/1980 | Kubota | 494/38 |
| 4,226,669 | 10/1980 | Vilardi | 494/12 |
| 4,360,151 | 11/1982 | Cowell et al. | 494/16 |
| 4,953,742 | 9/1990 | Kraus | 220/307 |
| 5,071,402 | 12/1991 | Weyant, Jr. | 494/16 |
| 5,344,380 | 9/1994 | Chern et al. | 494/16 |
| 5,379,907 | 1/1995 | Niedospial et al. | 215/355 |

FOREIGN PATENT DOCUMENTS

| | | | |
|---|---|---|---|
| 2907001 | 8/1979 | Germany | 494/16 |

OTHER PUBLICATIONS

Sorval SL–50T SL–250T ST–Micro Rotor Manual, *Du Pont Company*, 1–4, 1–5, Dec. 1992.

Engineering Drawing 490001, *Ian Sorvall Inc.*

*Primary Examiner*—Timothy F. Simone

*Assistant Examiner*—Tony G. Soohoo

[57] ABSTRACT

The present invention is directed to a centrifuge rotor having a rotor body and an associated lid. A skirt with a radially outwardly facing surface thereon depends from the radially outer peripheral undersurface of the lid. A contoured cut-out is formed in at least the radially outwardly facing surface of the skirt. The undersurface of the lid radially outwardly of the skirt also has a generally contoured cut-out formed therein. The contours of the cut-out portions meld together and cooperate to define a smoothly curved concave undercut region below the periphery of the lid that accepts a lifting implement, whereby lifting or lowering of the rotor may be facilitated.

11 Claims, 2 Drawing Sheets

CENTRIFUGE ROTOR

BACKGROUND OF THE INVENTION

1. Field of the Invention The present invention relates to a centrifuge rotor having a lid with a concave undercut region thereon.

2. Description of the Prior Art A centrifuge rotor is a relatively massive member in which a liquid sample is exposed to a centrifugal force field. To effect the centrifugal separation the rotor is mounted onto a drive shaft that projects into the chamber of a centrifuge instrument. The operator must hold and support the rotor while lowering it onto the drive shaft or lifting it therefrom. Since in the general case, the exterior configuration of the rotor does not present a usable lifting feature, the rotor must be held by the user by placing a hand beneath the body of the rotor and supported while the rotor is extended from the body of the user to or from the drive shaft. Depending upon the depth of the chamber and the location of the chamber with respect to the operator, such manipulations may be ergonomically disadvantageous.

There are known in the art rotors in which a peripheral portion of the lid overhangs the rotor body. Exemplary of this class of rotor are those rotors manufactured and sold by the Centrifuge Products Division of E. I. du Pont de Nemours and Company as SZ-14 and SL-50T. However, owing to the marginal extent to which the lid overhangs the rotor body, coupled with the perpendicular orientation of the lid with respect to rotor body, an inefficient lifting and grasping surface is presented to the user.

In view of the foregoing it is believed to be advantageous to provide a rotor which presents a surface to a user by which the rotor may be more efficiently grasped and handled.

SUMMARY OF THE INVENTION

The present invention is directed to a centrifuge rotor comprising a rotor body and an associated lid. The rotor body has an axis of rotation extending therethrough. The rotor body has a radially outer peripheral portion with a generally upstanding rim thereon. The upper extent of the upstanding rim inclines inwardly toward the axis of rotation at a predetermined angle. A skin depends from the radially outer peripheral undersurface of the lid. The skin has a radially outwardly facing surface thereon. A contoured cut-out is formed in at least the radially outwardly facing surface of the skirt. Preferably, the undersurface of the lid radially outwardly of the skin also has a generally contoured cut-out formed therein. The contours of the cut-out portions meld together and cooperate to define a smoothly curved concave undercut region below the periphery of the lid. The concave undercut region is shaped to accept snugly and securely a lifting implement whereby lifting or lowering of the rotor may be facilitated. The fingers of the hands of a user may form a suitable lifting implement.

BRIEF DESCRIPTION OF THE DRAWINGS

The present invention will be fully understood from following detailed description thereof, taken in connection with the accompanying drawings, which form a part of this application, and in which.

DETAILED DESCRIPTION OF THE INVENTION

Figure 1:
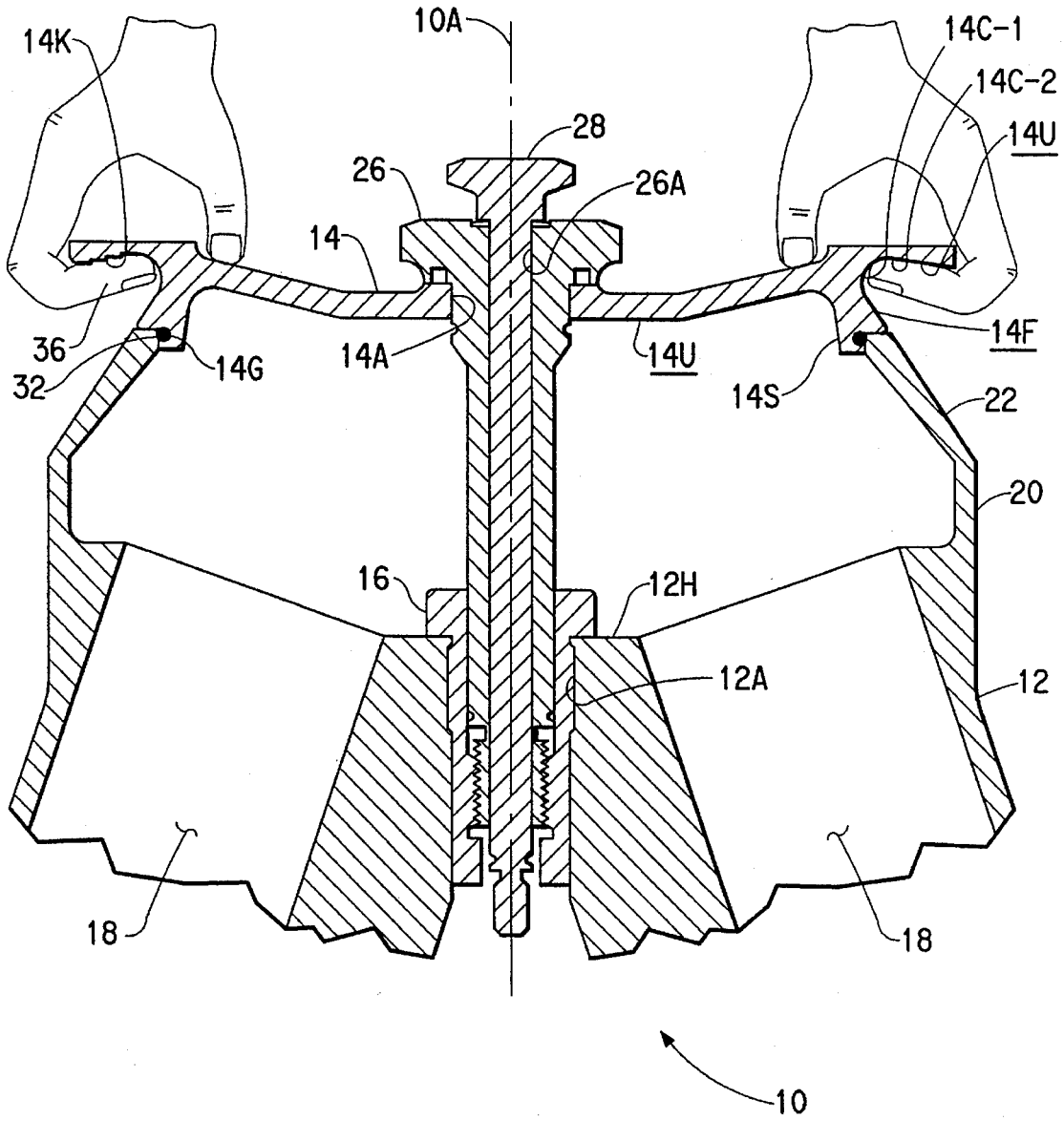
FIG. 1 is a side elevational view, entirely in section, of the upper portion of a rotor in accordance with the present invention.

Throughout the following detailed description similar reference numerals refer to similar elements in all Figures of the drawings.

With reference to the FIG. 1 shown in side elevation, entirely in section is a centrifuge rotor 10 in accordance with the present invention. The rotor 10 comprises a rotor body 12 and an associated lid 14. Only the upper portion of the rotor body at which the present invention resides is shown for economy of illustration. The rotor 10 has an axis of rotation 10A extending therethrough.

The central hub region 12H of the main portion of the rotor body 12 has a threaded opening 12A therein in which a threaded mounting adapter 16 is received. The adapter 16 itself has a central opening extending therethrough. The radially outer region of the rotor body 12 has a plurality of sample container receiving cavities 18 disposed therein. The radially outer peripheral portion of the rotor body radially outwardly of the mouths of the cavities 18 defines a generally upstanding rim region 20. The upper portion 22 of the upstanding rim 20 is inclined radially inwardly toward the axis of rotation 10A. The portion 22 of the rim 20 may incline at any predetermined convenient angle.

The rotor lid 14 is a generally flattened, disc-like member having a central opening 14A formed therein. The axis of the opening 14A is collinear with the axis 10A of the rotor. A locking stud 26 extends through the central opening 14A in the lid 14 into threaded engagement with the mounting adapter 16, whereby the lid 14 may be secured to the rotor body 12. A threaded rotor mounting bolt 28 extends through a central axial opening 26A in the locking stud 26. The mounting bolt 28 is threadedly engagable with-a correspondingly threaded recess formed at the upper end of a drive shaft (not shown) of the centrifuge instrument.

The lid 14 has an undersurface 14U thereon. A peripheral skirt 14S depends downwardly from the undersurface 14U of the radially outer peripheral region of the lid 14. The skirt 14S having a radially outwardly facing surface 14F thereon. A groove 14G is provided in the tip portion of the skirt 14S. The skirt 14S seats on the upper portion 22 of the upstanding rim 20. The sealed integrity of the interface between the skirt 14S and the upper portion 22 of the rim 20 is insured by an o-ring seal 32 disposed conveniently in the groove 14G. Of course, the groove for the seal may be provided in the portion 22 of the rim 20, if desired.

In the preferred implementation of the invention both the radially outwardly facing surface 14F of the skirt 14S and a portion of the undersurface 14U of the lid lying radially outwardly of the skirt 14S both have a contoured cut-out region formed therein. The contoured cut-out region formed in the radially outwardly facing surface 14F of the skirt 14S is indicated by the reference character 14C-1 while the contoured cut-out portion of the undersurface 14U is indicated by the reference character 14C-2. The cut-out portions 14C-1, 14C-2 may be formed in the lid 14 in any convenient manner, as for example, by lathe turning.

The contours of the cut-out portions 14C-1, 14C-2 meld together and cooperate to define a smoothly curved concave undercut region 36 below the periphery of the lid 14. Thus, in use, the concave undercut region 36 is shaped to accept snugly and securely a lifting implement whereby a lifting force may be imposed on the rotor 10. In practice the crooked fingers of the hands of the operator may define the lifting implement. The concave undercut region 36 is shaped to accept the tips of the fingers of a human hand, as suggested in FIG. 1. The concavity of the undercut region 36 provides a secure gripping surface that prevents radially outward slippage of the fingers. To enhance gripability the portion of the undersurface 14U having the cut-out portion 14C-2 therein may optionally be serrated, if desired, as indicated in the left-hand portion of FIG. 1 indicated by the reference character 14K.

Figure 2:
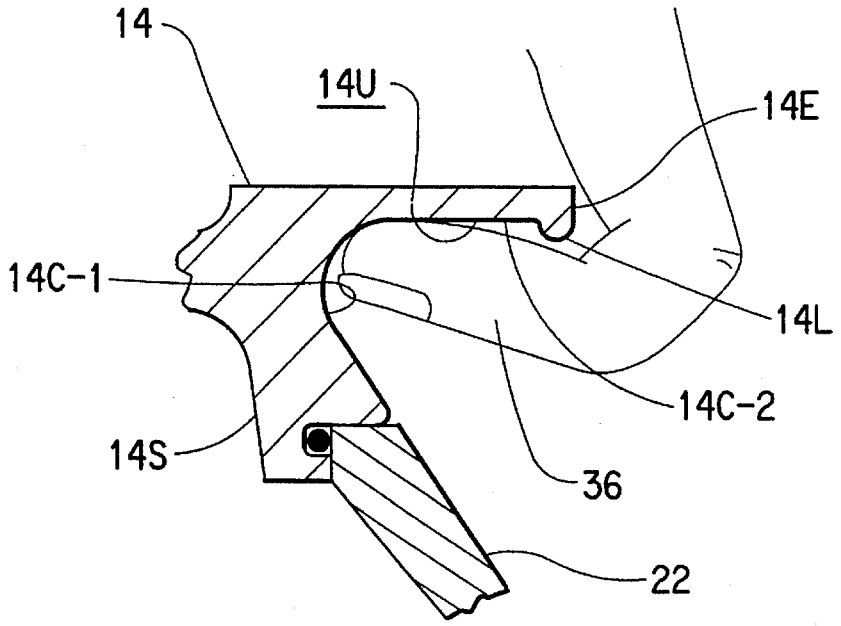
FIGS. 2 and 3 are fragmentary sectional views of alternate embodiments of the rotor of FIG. 1.
Figure 3:
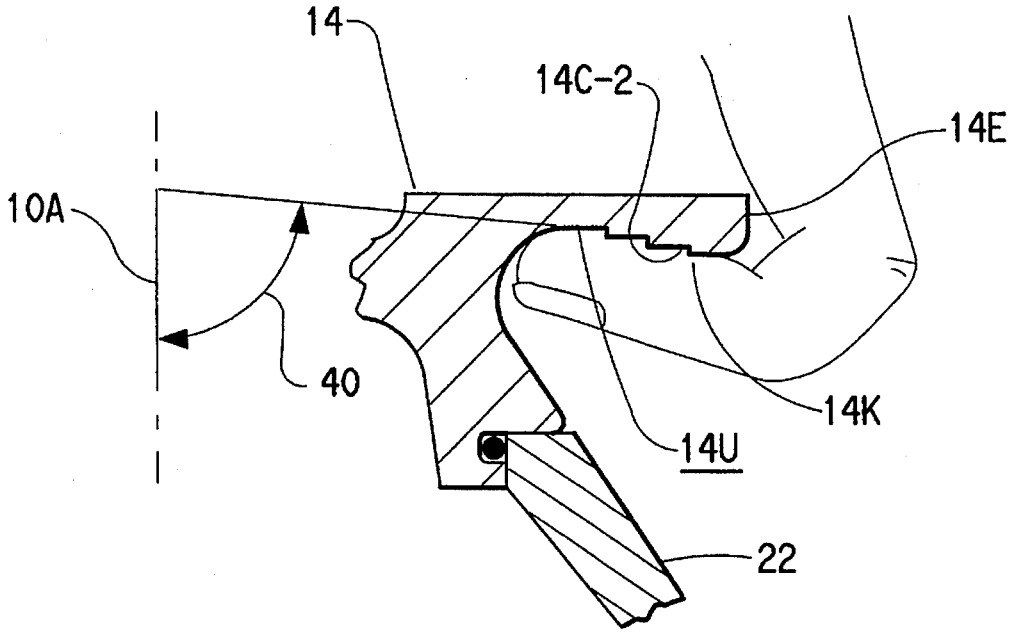

Other optional variations of the present invention are illustrated in FIGS. 2 and 3, which are enlarged sectional views of the portion of the lid 14 in the vicinity of the skirt 14S. In FIG. 2, the cut-out portion 14C-2 formed in the portion of the undersurface 14U is generally planar in configuration. Radially outward slippage of the fingers is inhibited by the presence of a circumferentially extending lip 14L disposed at the radially outer edge 14E of the undersurface 14U of the lid 14. As shown in FIG. 1, the serrations 14K may optionally be provided.

In FIG. 3, the generally planar cut-out portion 14C-2 formed in the portion of the undersurface 14U is inclined at a predetermined angle 40 with respect to the axis 10A, the inclination of the angle 40 being less than ninety degrees, and more preferably, in the range of 40 to 85 degrees. Again, if desired, the generally planar surface may have serrations 14K thereon.

As seen in FIG. 1, the radially outer edge of the surface 14F of the skirt 14S joins smoothly with the upper extremity of the radially inward inclined upper portion 22 of the upstanding rim 20. The inclination of the upper portion 22 provides increased access to the concave undercut region 36. Of course, if the skirt portion 14S of the lid 14 is of sufficient height, the upper portion 20 of the rotor body 12 need not be inclined. In the preferred case the radially outer edge 14E of the lid 14 is radially coextensive with or radially inward of the generally upstanding rim portion 20 of the rotor body 12.

Those skilled in the art, having the benefit of the teachings of the present invention may impart numerous modifications thereto. Such modifications are to be construed as lying within the scope of the present invention, as defined by the appended claims.

What is claimed is:

1. A centrifuge rotor comprising:

a rotor body having an axis of rotation extending therethrough, the rotor body having a radially outer peripheral portion having a generally upstanding rim thereon, an upper portion of the upstanding rim being inclined inwardly toward the axis of rotation at a predetermined angle; and a rotor lid, the lid having an undersurface thereon, the lid comprising:

a skirt depending from the undersurface of the lid, the skirt having a radially outwardly facing surface thereon, the radially outwardly facing surface of the skirt having a contoured cut-out formed therein, the contoured cut-out being accessible from the exterior of the rotor for facilitating the grasping and handling of the rotor.

2. The rotor of claim 1 wherein a portion of the undersurface of the lid lies radially outwardly of the skirt, and wherein the undersurface of the lid radially outwardly of the skirt is a generally planar surface.

3. The rotor of claim 2 wherein the generally planar surface has serrations thereon.

4. The rotor of claim 2 wherein the undersurface of the rotor has a radially outer edge thereon, the lid further comprising a lip disposed at the radially outer edge of the undersurface of the lid.

5. The rotor of claim 2 having a central opening with an axis extending therethrough, and wherein the generally planar surface of the lid radially outwardly of the skirt is inclined at a predetermined angle with respect to the axis, the angle of inclination being less than ninety degrees.

6. The rotor of claim 2 wherein the angle of inclination is in the range of 40 to 85 degrees.

7. The rotor of claim 2 wherein the inclined generally planar surface has serrations thereon.

8. The rotor of claim 1 wherein the undersurface of the lid radially outwardly of the skirt also has a contoured cut-out formed therein, the contoured cut-out portion of the undersurface of the lid cooperating with the contoured cut-out portion of the skirt to define a concave undercut region.

9. The rotor of claim 8 wherein the contoured cut-out portion of the undersurface of the lid has serrations thereon.

10. The rotor of claim 1 wherein the lid has a radially outer edge thereon and wherein the radially outer edge of the lid is radially coextensive with the generally upstanding rim portion of the rotor body.

11. The rotor of claim 1 wherein the lid has a radially outer edge thereon and wherein the radially outer edge of the lid is radially inward of the generally upstanding rim portion of the rotor body.

* * * * *